US007444842B2

(12) United States Patent
Kim et al.

(10) Patent No.: US 7,444,842 B2
(45) Date of Patent: Nov. 4, 2008

(54) DRUM WASHING MACHINE AND METHOD OF CONTROLLING THE SAME

(75) Inventors: Hyun Sook Kim, Suwon (KR); Ki Hun Joo, Suwon (KR); Ki Su Lee, Suwon (KR); Hyun Mu Lee, Suwon (KR); Uk Jin Jang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 624 days.

(21) Appl. No.: 10/811,852

(22) Filed: Mar. 30, 2004

(65) Prior Publication Data

US 2005/0028297 A1 Feb. 10, 2005

(30) Foreign Application Priority Data

Aug. 8, 2003 (KR) ..... 10-2003-0055006

(51) Int. Cl.
*D06F 33/02* (2006.01)
*D06F 39/02* (2006.01)

(52) U.S. Cl. ..... 68/12.18; 68/17 R; 68/23.5; 68/207

(58) Field of Classification Search ..... 68/24, 68/12.18, 12.23, 17 R, 23 R, 23.5, 58, 207
See application file for complete search history.

(56) References Cited

U.S. PATENT DOCUMENTS 4,489,455 A * 12/1984 Spendel ..... 8/158
4,489,574 A * 12/1984 Spendel ..... 68/16
4,986,093 A * 1/1991 Pastryk et al. ..... 68/13 R
4,987,627 A * 1/1991 Cur et al. ..... 8/158
5,140,842 A * 8/1992 Kiuchi et al. ..... 68/12.02
5,233,718 A * 8/1993 Hardaway et al. ..... 8/158
5,249,441 A * 10/1993 Pastryk et al. ..... 68/23.4
5,271,251 A * 12/1993 Kovich et al. ..... 68/171
5,438,507 A * 8/1995 Kim et al. ..... 700/1
5,507,053 A * 4/1996 Mueller et al. ..... 8/158
5,870,906 A * 2/1999 Denisar ..... 68/17 R
6,269,666 B1 * 8/2001 Whah et al. ..... 68/12.02

(Continued)

FOREIGN PATENT DOCUMENTS

CH 662 804 10/1987

(Continued)

OTHER PUBLICATIONS

U.S. Appl. No. 10/811,853, filed Mar. 30, 2004, Kim et al., Samsung Electronics Co., Ltd.

(Continued)

*Primary Examiner*—Joseph L Perrin
(74) *Attorney, Agent, or Firm*—Staas & Halsey LLP

(57) ABSTRACT

A drum washing machine including a water tub, a rotary tub rotatably provided in the water tub, a detergent feed pipe having a first end connected to the water tub and a second end disposed at an inlet of the rotary tub, and a detergent feed unit to feed a detergent contained in the water tub into the rotary tub through the detergent feed pipe, wherein the detergent feed unit dissolves the detergent before feeding the detergent into the rotary tub in response to the detergent being a powdered detergent.

15 Claims, 3 Drawing Sheets

U.S. PATENT DOCUMENTS

| | | | | |
|---|---|---|---|---|
| 6,393,872 | B2 * | 5/2002 | Whah et al. | 68/12.02 |
| 6,584,811 | B2 * | 7/2003 | Whah et al. | 68/12.04 |
| 6,591,639 | B2 * | 7/2003 | Voth | 68/5 E |
| 2003/0208855 | A1 * | 11/2003 | McAllister et al. | 8/159 |

FOREIGN PATENT DOCUMENTS

| | | |
|---|---|---|
| CN | 1137079 | 12/1996 |
| EP | 1 375 728 | 1/2004 |
| WO | 02/081808 | 10/2002 |

OTHER PUBLICATIONS

U.S. Appl. No. 10/811,851, filed Mar. 30, 2004, Kim et al., Samsung Electronics Co., Ltd.
Patent Abstracts of Japan, vol. 2000, No. 23, Feb. 10, 2001 & JP 2001 170392A (Toshiba Corp), Jun. 26, 2001 (Abstract).
Patent Abstracts of Japan, vol. 2002, No. 2, Apr. 2, 2002 & JP 2001 276484A (TOTO Ltd), Oct. 9, 2001 (Abstract).
European Search Report dated Sep. 5, 2005.
Chinese Office Action dated Aug. 25, 2005 for related Chinese Patent Application No. 2004100335622.

* cited by examiner

DRUM WASHING MACHINE AND METHOD OF CONTROLLING THE SAME

CROSS-REFERENCE TO RELATED APPLICATIONS

This application claims the benefit of Korean Patent Application No. 2003-55006, filed Aug. 8, 2003 in the Korean Intellectual Property Office, the disclosure of which is incorporated herein by reference.

BACKGROUND OF THE INVENTION

1. Field of the Invention

The present invention relates, in general, to drum washing machines, and, more particularly, to a drum washing machine, and a method of controlling the drum washing machine, which improves washing performance by increasing utilization efficiency of a powdered or liquid detergent.

2. Description of the Related Art

Generally, a drum washing machine is a device that includes a water tub, which is a fixed tub, and a rotary tub having a drum shape that is rotatably provided in the water tub. The drum washing machine washes laundry using drops of water generated by a rotation of the rotary tub.

A conventional drum washing machine executes a washing process by supplying a detergent and a set amount of water together into a water tub, dissolving the detergent in the water only through an opposite directional rotation of a rotary tub, and allowing the dissolved detergent to soak through laundry. The washing process is performed thusly regardless of a type of detergent used, examples of which being powdered detergent and liquid detergent.

However, in the conventional drum washing machine, the detergent supplied into the water tub sinks to a bottom of the water tub, and dissolves in water while the rotary tub is rotated in opposite directions. Therefore, a liquid detergent may sufficiently dissolve only through the opposite directional rotation of the rotary tub. However, in the case of a powdered detergent, there is a problem in that it takes a relatively long time for the powdered detergent to dissolve, thus increasing a washing time in proportion to the time required for the sufficient dissolution of the powdered detergent. Further, in the case of the powdered detergent, it is difficult to sufficiently dissolve the powdered detergent only through the opposite directional rotation of the rotary tub even with a longer washing time. Therefore, there is a problem in that detergent deposits remain, which decreases washing performance.

Meanwhile, in the conventional drum washing machine, a detergent solution, in which a powdered detergent or liquid detergent is dissolved in the water, gradually soaks through a center part of the laundry from an outer part of the laundry by the opposite directional rotation of the rotary tub, with the outer part of the laundry coming into contact with an inner wall of the rotary tub. Therefore, it may take a relatively long time for the detergent solution to soak through to the center part from the lower part of the laundry, according to materials of the laundry. Further, the detergent solution may not sufficiently soak through the center part of the laundry according to various circumstances. Consequently, the conventional drum washing machine is problematic in that a washing time is increased and washing performance is deteriorated.

SUMMARY OF THE INVENTION

Accordingly, it is an aspect of the present invention to provide a drum washing machine, and a method of controlling the drum washing machine, which maximizes solubility and utilization efficiency of a detergent in a short time according to a type of detergent used, such as a powdered or liquid detergent.

Additional aspects and/or advantages of the invention will be set forth in part in the description which follows and, in part, will be obvious from the description, or may be learned by practice of the invention.

The above and/or other aspects are achieved by providing a drum washing machine including a water tub, a rotary tub rotatably provided in the water tub, and a detergent feed pipe having a first end connected to the water tub and a second end disposed at an inlet of the rotary tub, and a detergent feed unit to feed a detergent contained in the water tub into the rotary tub through the detergent feed pipe, wherein the detergent feed unit dissolves the detergent before feeding the detergent into the rotary tub in response to the detergent being a powdered detergent.

The detergent feed unit may include a pump provided at the detergent feed pipe.

The drum washing machine may further include a spray nozzle provided at the second end of the detergent feed pipe.

The drum washing machine may further include a detergent dissolution space formed at the detergent feed pipe to temporarily store the detergent.

The detergent feed unit may include a control unit to drive the pump to dissolve the powdered detergent and then feed the dissolved powdered detergent into the rotary tub.

The control unit may drive the pump to reciprocate the detergent contained in the water tub between an inside of the water tub and the detergent feed pipe to dissolve the powdered detergent.

The drum washing machine may further include a key input unit having a powdered detergent button and a liquid detergent button, the control unit determining whether the detergent contained in a lower portion of the water tub is the powdered detergent according to the powdered detergent button being selected in the key input unit.

The control unit may drive the pump to clean the detergent feed pipe in response to the detergent contained in the water tub being the powdered detergent.

The above and/or other aspects may also be achieved by providing a method of controlling a drum washing machine, the drum washing machine having a detergent feed pipe provided with a first end connected to a water tub and a second end disposed at an inlet of a rotary tub, the control method including feeding a liquid detergent into the rotary tub through the detergent feed pipe in response to a detergent contained in the water tub being the liquid detergent, and dissolving a powdered detergent before feeding the dissolved detergent into the rotary tub through the detergent feed pipe in response to the detergent contained in the water tub being the powdered detergent.

The drum washing machine control method may further include determining whether the detergent contained in the water tub is the powdered detergent or liquid detergent according to a powdered detergent button or a liquid detergent button selected by a user.

The dissolving and feeding of the powdered detergent and the feeding of the liquid detergent may be performed by driving a pump provided at the detergent feed pipe.

The dissolving of the powdered detergent may be performed by reciprocating the powdered detergent contained in the water tub between an inside of the water tub and the detergent feed pipe.

The drum washing machine control method may further include driving the pump to clean the detergent feed pipe after dissolving and feeding the powdered detergent.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
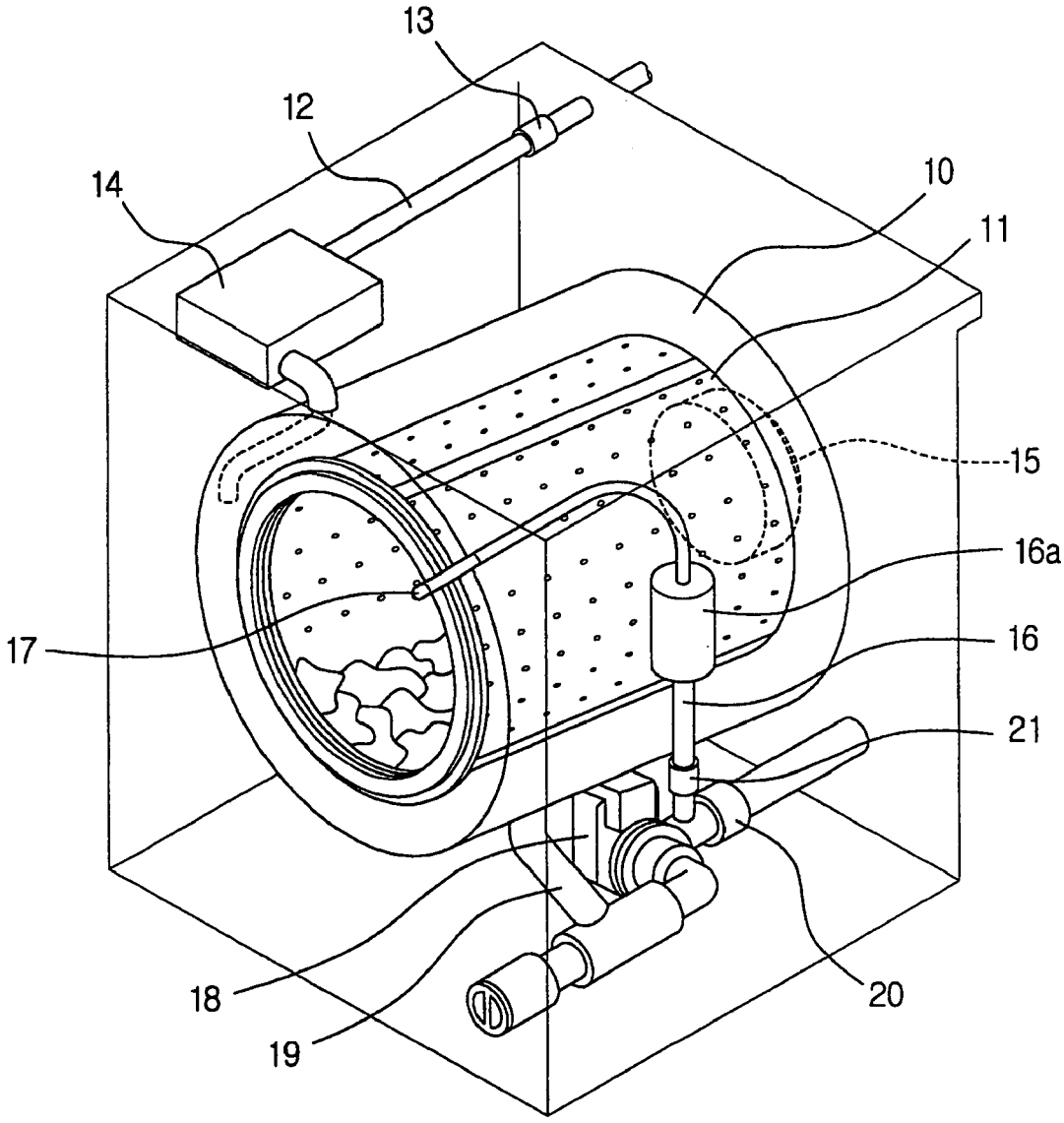
FIG. 1 is a perspective view showing an internal structure of a drum washing machine, according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a perspective view showing an internal structure of a drum washing machine, according to an embodiment of the present invention. As shown in FIG. 1, the drum washing machine of the present invention includes a water tub 10, and a rotary tub 11 which is rotatably provided in the water tub 10.

A water feed pipe 12, connecting an external water supply pipe and the water tub 10, is mounted at the water tub 10 to be supplied with wash water from the external water supply pipe.

A water feed valve 13 is mounted at the water feed pipe 12 to control a flow of water. A detergent container 14 capable of receiving a powdered detergent or liquid detergent is mounted at a portion of the water feed pipe 12 between the water feed valve 13 and the water tub 10.

Therefore, wash water flowing through the water feed pipe 12 runs over a detergent contained in the detergent container 14, so that the detergent is fed into the water tub 10 together with the wash water.

Further, a reversible motor 15 is set at a portion of the rotary tub 11. The reversible motor 15 rotates the rotary tub 11 in a single direction or opposite directions, Further, a detergent feed pipe 16, having a first end connected to the water tub 10 and a second end extended lengthwise outside of the water tub 10 to face an inlet of the rotary tub 11, is provided at the water tub 10. A cylindrical detergent dissolution space 16*a* with a diameter greater than that of the detergent feed pipe 16 is mounted at a center portion of the detergent feed pipe 16 to temporarily store a detergent. Further, a spray nozzle 17 is mounted at the second end of the detergent feed pipe 16 to spray the detergent into the rotary tub 11.

Further, the drum washing machine of the present invention is provided with a detergent feed unit that dissolves a powdered detergent and then feeds the dissolved detergent into the rotary tub 11 if the detergent contained in the water tub 10 is a powdered detergent, and feeds a liquid detergent into the rotary tub 11 if the detergent contained in the water tub 10 is a liquid detergent. The detergent feed unit includes, for example, a pump 18 provided at the detergent feed pipe 16 to pump the detergent contained in the water tub 10.

First, a process of dissolving and feeding a powdered detergent using the pump 18 is described. In the case where a detergent contained in the water tub 10 is a powdered detergent, the pump 18 is repeatedly turned on and off to periodically reciprocate the powdered detergent contained in a lower portion of the water tub 10 between the water tub 10 and the detergent feed pipe 16. Therefore, the solubility of the powdered detergent in the water is increased in a short time by an action of shaking and mixing the detergent. After the powdered detergent dissolves in the water, the pump 18 is turned on to feed the dissolved detergent into the rotary tub 11 through the detergent feed pipe 16 and spray nozzle 17. As a result, the dissolved detergent fed into the rotary tub 11 rapidly and uniformly soaks through the laundry regardless of materials of the laundry, thus increasing the utilization efficiency of the powdered detergent.

Further, a process of feeding a liquid detergent using the pump 18 is described. In the case where a detergent contained in the water tub 10 is a liquid detergent, the pump 18 is turned on to feed the liquid detergent contained in the water tub 10 into the rotary tub 11 through the detergent feed pipe 16 and spray nozzle 17. Therefore, the liquid detergent is directly sprayed on a center part of laundry, so that the liquid detergent rapidly and uniformly soaks through the laundry, thus increasing the utilization efficiency of the liquid detergent.

In the case of the liquid detergent, the detergent dissolving process required for the powdered detergent is not executed. This is due to the fact that, since the solubility of the liquid detergent is relatively higher than that of the powdered detergent according to characteristics of the liquid detergent, a separate detergent dissolving process using the pump 18 is not necessary. In the case of the liquid detergent, if the detergent dissolving process using the pump 18 is executed, bubbles may be generated, which lowers washing performance.

Meanwhile, the detergent feed pipe 16 may be branched from a drain pipe 19 that drains waste water contained in the water tub 10 through a drain outlet, as an example. In this case, the 18 and a drain valve 20 are mounted at the drain pipe 19. In this case, the above-described pump 18 may be a drain pump. Further, a backward flow prevention valve 21 is mounted at the detergent feed pipe 16 to prevent wash water from flowing into the water tub 10 when draining.

Figure 2:
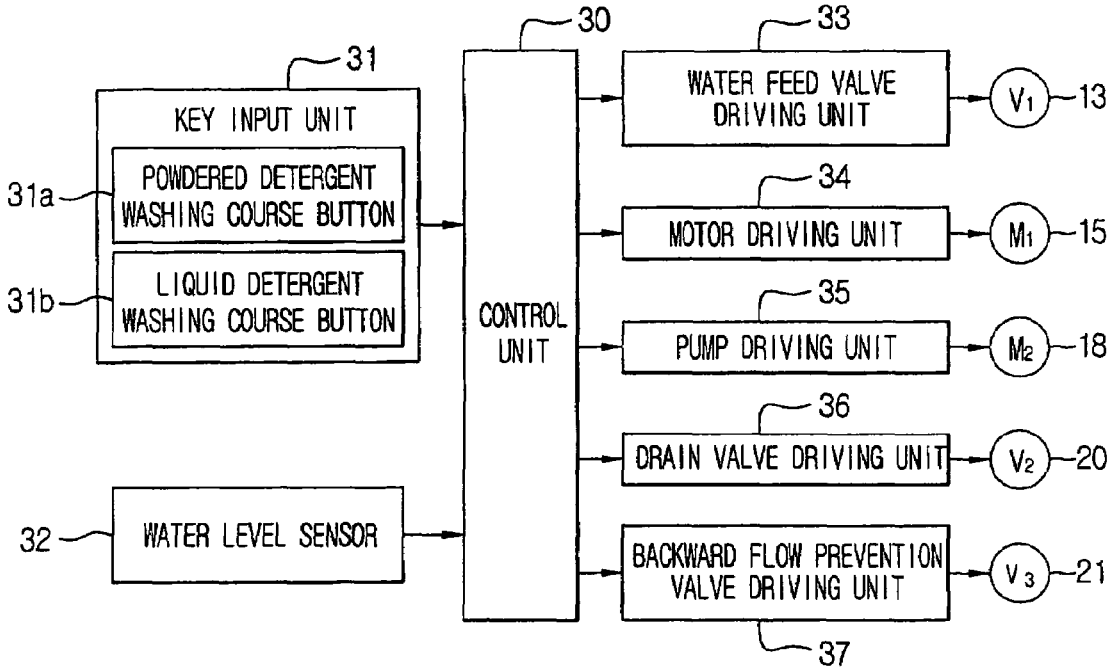
FIG. 2 is a control block diagram of the drum washing machine of FIG. 1.

FIG. 2 is a control block diagram of the drum washing machine of FIG. 1. As shown in FIG. 2, the drum washing machine of the present invention includes a control unit 30 that controls an entire operation of the drum washing machine.

An input terminal of the control unit 30 is electrically connected to a key input unit 31 having washing course buttons according to types of detergents used, such as a powdered detergent washing course button 31*a* and a liquid detergent washing course button 31*b*, which are selected by a user, and a water level sensor 32 that detects a level of water contained in the rotary tub 11.

Further, an output terminal of the control unit 30 is electrically connected to a water feed valve driving unit 33 to drive the water feed valve 13, a motor driving unit 34 to drive the motor 15, a pump driving unit 35 to drive the pump 18, a drain valve driving unit 36 to drive the drain valve 20, and a backward flow prevention valve driving unit 37 to drive the backward flow prevention valve 21.

The control unit 30 determines whether a detergent used is a powdered detergent or liquid detergent depending on a corresponding one selected by the user among the buttons, such as the powdered detergent washing course button 31*a* and the liquid detergent washing course button 31*b*, provided in the key input unit 31. If the detergent is a powdered detergent, the control unit 30 drives the pump 18 to dissolve the powdered detergent contained in the water tub 10, and then sprays and feeds the dissolved detergent into the rotary tub 11. On the other hand, if the detergent is a liquid detergent, the control unit 30 drives the pump 18 to spray and feed the liquid detergent contained in the water tub 10 into the rotary tub 11.

Further, after dissolving the powdered detergent and then feeding the dissolved detergent into the rotary tub 11, the control unit 30 drives the pump 18 to clean the detergent feed pipe 16 during washing.

Hereinafter, a method of controlling the drum washing machine of the present invention is described through a detailed operating process of the drum washing machine.

Figure 3:
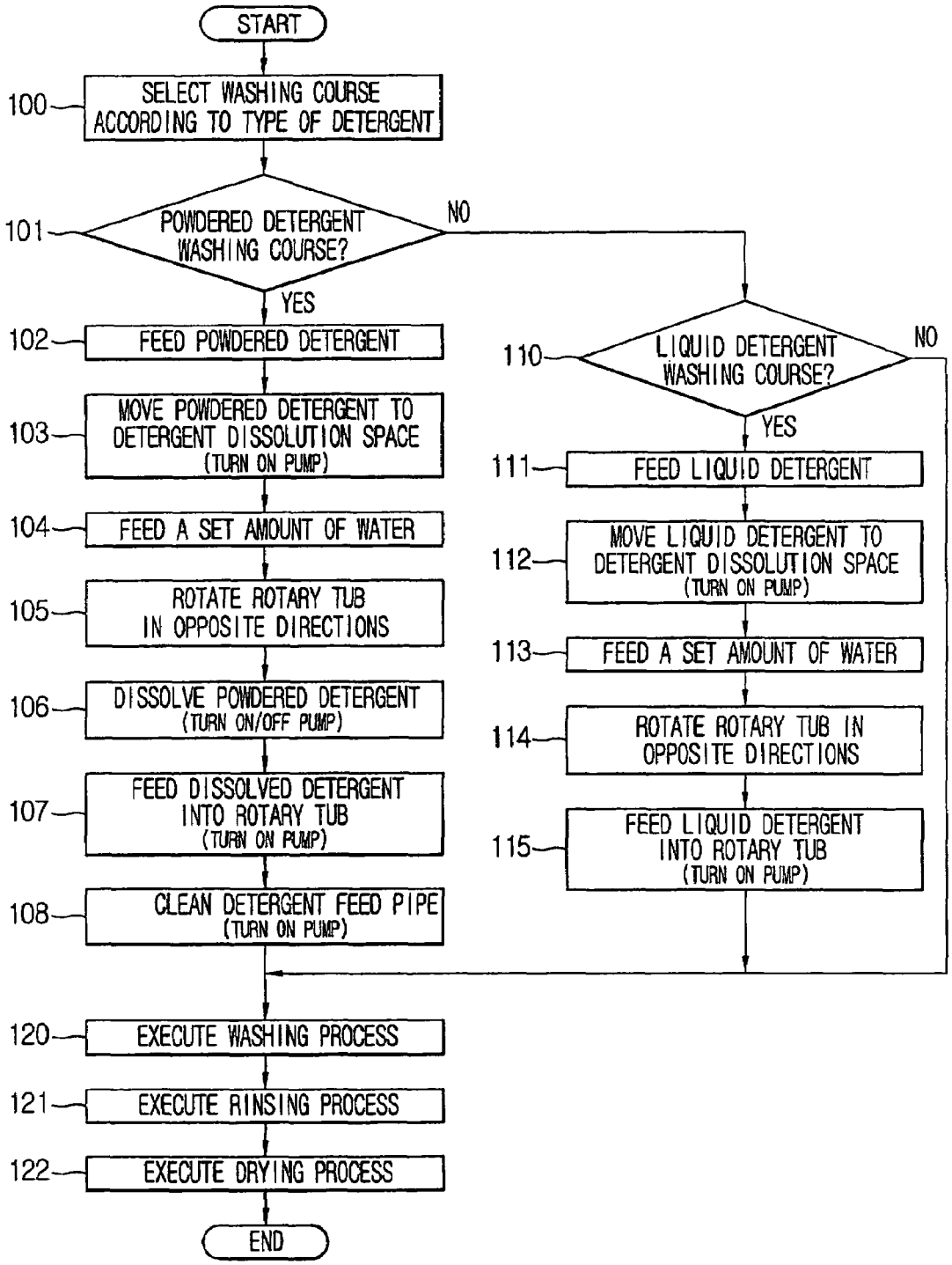
FIG. 3 is a control flowchart of a method of controlling the drum washing machine, according to an embodiment of the present invention such as shown in FIG. 1.

FIG. 3 is a control flowchart of the method of controlling the drum washing machine, according to an embodiment of the present invention such as shown in FIG. 1. Referring to FIG. 3, a washing course according to the type of detergent used is selected by a user in operation 100.

After the washing course according to the type of detergent used is selected by the user, the control unit 30 determines whether the selected washing course is a powdered detergent washing course or a liquid detergent washing course in operation 101.

If the selected washing course is the powdered detergent washing course in operation 101, the control unit 30 opens the water feed valve 13 for a certain period of time to allow a predetermined amount of wash water to flow into the water tub 10 while running over the detergent container 14, thus feeding a powdered detergent, which is put in the detergent container 14 in advance by the user, into the water tub 10 in operation 102.

After feeding the powdered detergent in operation 102, the control unit 30 turns on the pump 18 to move the powdered detergent, which has sunk to a bottom of the water tub 10, to the detergent dissolution space 16*a* formed at the detergent feed pipe 16 in operation 103.

After moving the powdered detergent to the detergent dissolution space 16*a* in operation 103, the control unit 30 opens the water feed valve 13 again to feed a set amount of water into the water tub 10 in operation 104. After feeding the set amount of water in operation 104, the control unit 30 rotates the motor 15 in forward and reverse directions to rotate the rotary tub 11 in opposite directions in operation 105. Accordingly, the laundry contained in the rotary tub 11 is soaked with the water.

While rotating the rotary tub 11 in opposite directions in operation 105, the control unit 30 repeatedly turns the pump 18 on and off to move the powdered detergent which is temporarily stored in the detergent dissolution space 16*a* into the water tub 10, and to dissolve the powdered detergent in the water while reciprocating the powdered detergent between the water tub 10 and the detergent dissolution space 16*a*, in operation 106.

After dissolving the powdered detergent in operation 106, the control unit 30 extends a turn-on time of the pump 18, thus spraying and feeding the detergent dissolved in the detergent dissolution space 16*a* into the rotary tub 11 in operation 107.

Therefore, through the detergent dissolving procedure of operation 106, the solubility of the powdered detergent is increased in a short time. Further, through the detergent spraying and feeding procedure of operation 107, the dissolved detergent is sprayed into the rotary tub 11 to directly soak through a center part of the laundry, thus greatly improving the utilization efficiency of the powdered detergent. Consequently, a washing time may be shortened and washing performance may be improved.

After spraying and feeding the dissolved detergent into the rotary tub 11 in operation 107, the control unit 30 pumps the water contained in the water tub 10 to the detergent feed pipe 16 by repeatedly turning on the pump 18 a certain number of times, thus cleaning the detergent feed pipe 16 in operation 108.

After completing the cleaning of the detergent feed pipe 16 in operation 108, the control unit 30 executes preset washing, rinsing and drying processes in operations 120, 121, and 122, respectively, and then ends the washing course.

Meanwhile, if the selected washing course is not a powdered detergent washing course in operation 101, the control unit 30 determines whether the washing course is a liquid detergent washing course in operation 110.

If the washing course is the liquid detergent washing course in operation 110, the control unit 30 opens the water feed valve 13 for a certain period of time to allow a predetermined amount of wash water to flow into the water tub 10 while running over the detergent container 14, thus feeding a liquid detergent, which is put in the detergent container 14 in advance by the user, into the water tub 10 in operation 111.

After feeding the liquid detergent in operation 111, the control unit 30 turns on the pump 18 to move the liquid detergent, sunk to the bottom of the water tub 10, to the detergent dissolution space 16*a* formed at the detergent feed pipe 16 in operation 112.

After moving the liquid detergent to the detergent dissolution space 16*a* in operation 112, the control unit 30 opens the water feed valve 13 again to feed a set amount of water into the water tub 10 in operation 113. While feeding the set amount of water, the control unit 30 rotates the motor 15 in forward and reverse directions to rotate the rotary tub 11 in opposite directions in operation 114.

After rotating the rotary tub 11 in opposite directions in operation 114, the control unit 30 extends a turn-on time of the pump 18, thus spraying and feeding the liquid detergent temporarily stored in the detergent dissolution space 16*a* into the rotary tub 11 in operation 115. Therefore, through the detergent spraying and feeding procedure of operation 115, the liquid detergent is sprayed into the rotary tub 11 to directly soak through the center part of the laundry, thus greatly improving the utilization efficiency of the liquid detergent. Consequently, a washing time may be shortened and washing performance may be improved.

Further, after completing the detergent spraying and feeding procedure in operation 115, the control unit 30 executes preset washing, rinsing and drying processes in operations 120, 121, and 122, respectively, and then ends the washing course.

As is apparent from the above description, the present invention provides a drum washing machine, and a method of controlling the drum washing machine, which controls washing courses to correspond with types of detergents so as to improve the solubility and utilization efficiency of detergents according to the types of detergents used, such as a powdered detergent or liquid detergent, thus increasing the solubility and utilization efficiency of the detergents in a short time. Consequently, the present invention is advantageous in that it improves washing performance while decreasing a washing time.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A drum washing machine, comprising:

a key input unit receiving an input from a user;

a water tub;

a rotary tub rotatably provided in the water tub;

a detergent feed pipe having a first end connected to the water tub and a second end disposed at an inlet of the rotary tub;

a control unit determining whether a detergent used is a powdered detergent or a liquid detergent based on the input from the user; and a detergent feed unit to feed the detergent contained in the water tub into the rotary tub through the detergent feed pipe, the control unit controlling the detergent feed unit to dissolve the detergent before feeding the detergent into the rotary tub in response to a determination from the control unit that the detergent is a powdered detergent;

wherein the detergent feed unit comprises a control unit to drive a pump provided at the detergent feed pipe to sufficiently dissolve the powdered detergent and then feed the dissolved powdered detergent into the rotary tub.

2. The drum washing machine according to claim 1, further comprising a spray nozzle provided at the second end of the detergent feed pipe to spray the detergent into the rotary tub.

3. The drum washing machine according to claim 1, further comprising a detergent dissolution space formed at the detergent feed pipe to temporarily store the detergent.

4. The drum washing machine according to claim 1, further comprising:

a detergent dissolution space formed at the detergent feed pipe to temporarily store the detergent; and a water feed valve;

wherein the control unit opens the water feed valve to feed a set amount of water into the water tub after the powdered detergent is moved into the detergent dissolution space.

5. The drum washing machine according to claim 4, further comprising a motor to rotate the rotary tub in opposite directions, wherein the control unit controls the motor to rotate the rotary tub after feeding the set amount of water into the water tub.

6. The drum washing machine according to claim 5, wherein the control unit repeatedly turns the pump on and off to move the powdered detergent back and forth from the water tub to the detergent dissolution space to dissolve the powdered detergent.

7. The drum washing machine according to claim 1, wherein the control unit drives the pump to reciprocate the detergent contained in the water tub between an inside of the water tub and the detergent feed pipe to dissolve the powdered detergent.

8. The drum washing machine according to claim 1, wherein the key input unit has a powdered detergent button, the control unit determining whether the detergent contained in a lower portion of the water tub is the powdered detergent according to the powdered detergent button being selected in the key input unit.

9. The drum washing machine according to claim 8, wherein the key input unit further comprises a liquid detergent button by which the control unit determines the detergent contained in the lower portion of the water tub is a liquid detergent.

10. The drum washing machine according to claim 1, wherein the control unit drives the pump to clean the detergent feed pipe in response to the detergent contained in the water tub being the powdered detergent.

11. A drum washing machine, comprising:

an key input unit receiving an input from a user;

a water tub;

a rotary tub provided in the water tub;

a control unit determining whether a detergent used is a powdered detergent or a liquid detergent based on the input received through the key input unit; and a detergent feed unit to feed the detergent contained in the water tub into the rotary tub, the control unit causing the detergent feed unit to drive a pump provided at the detergent feed pipe to sufficiently dissolve the detergent before feeding the detergent into the rotary tub in response to a determination from the control unit that the detergent is a powdered detergent.

12. The drum washing machine according to claim 11, wherein the detergent feed unit feeds the detergent contained in the water tub to the rotary tub without dissolving the detergent in response to the detergent being a liquid detergent.

13. The drum washing machine according to claim 11, wherein the pump reciprocates the powdered detergent in and out of the water tub to dissolve the powdered detergent.

14. A drum washing machine, comprising:

a key input unit receiving an input from a user;

a water tub;

a rotary tub;

a spraying unit; and a control unit determining, based on the input received through the key input unit, whether the detergent is powdered or liquid, causing a pump to sufficiently dissolve a detergent contained in the water tub in response to the determination by the control unit, and then causing the spraying unit to spray the dissolved detergent into the rotary tub by the spraying unit to soak a center of a laundry load.

15. A drum washing machine, comprising:

a key input unit receiving an input from a user;

a water tub;

a rotary tub provided in the water tub; and a detergent feed unit;

a control unit making a determination based on the input received from the key input unit as to whether a detergent is a first type of detergent or a second type of detergent and selectively causing the first type of detergent to be dissolved in the detergent feed unit before being fed from the water tub to the rotary tub without being dissolved in the detergent feed unit;

wherein the detergent feed unit comprises a control unit to drive a pump provided at the detergent feed pipe to sufficiently dissolve the powdered detergent and then feed the dissolved powdered detergent into the rotary tub.

* * * * *

UNITED STATES PATENT AND TRADEMARK OFFICE

CERTIFICATE OF CORRECTION

PATENT NO. : 7,444,842 B2
APPLICATION NO. : 10/811852
DATED : November 4, 2008
INVENTOR(S) : Hyun Sook Kim et al.

It is certified that error appears in the above-identified patent and that said Letters Patent is hereby corrected as shown below:

Column 8, Line 11, before “key” change “an” to --a--.

Column 8, Lines 47-48, change
“a rotary tub provided in the water tub; and
a detergent feed unit;”
to
--a rotary tub provided in the water tub;
a detergent feed unit; and--.

Signed and Sealed this

Third Day of February, 2009

John Doll

JOHN DOLL
*Acting Director of the United States Patent and Trademark Office*